US007882641B2

(12) United States Patent
Repac

(10) Patent No.: US 7,882,641 B2
(45) Date of Patent: Feb. 8, 2011

(54) DEVICE FOR CUTTING PRODUCE, IN PARTICULAR VEGETABLES OR FRUIT

(76) Inventor: Cedomir Repac, Fliederweg 24, Brechen (DE) 65661

( * ) Notice: Subject to any disclaimer, the term of this patent is extended or adjusted under 35 U.S.C. 154(b) by 401 days.

(21) Appl. No.: 11/988,066

(22) PCT Filed: Mar. 9, 2007

(86) PCT No.: PCT/EP2007/002085

§ 371 (c)(1),
(2), (4) Date: Dec. 28, 2007

(87) PCT Pub. No.: WO2007/101705

PCT Pub. Date: Sep. 13, 2007

(65) Prior Publication Data

US 2009/0078100 A1 Mar. 26, 2009

(30) Foreign Application Priority Data

Mar. 9, 2006 (DE) ..... 10 2006 011 386

(51) Int. Cl.
*B26D 3/18* (2006.01)

(52) U.S. Cl. ..... 30/114; 83/167

(58) Field of Classification Search ..... 30/114, 30/115, 117, 299, 303, 304; 83/167, 932
See application file for complete search history.

(56) References Cited

U.S. PATENT DOCUMENTS 1,263,151 A 4/1918 Topalian
1,962,737 A * 6/1934 Gutmann ..... 30/173
1,979,199 A * 10/1934 Haynes ..... 83/608
4,062,260 A 12/1977 Steinhogl
4,383,365 A * 5/1983 Metzigian ..... 30/114
6,860,016 B2 3/2005 Holcomb et al.
D576,454 S * 9/2008 Repac ..... D7/693
7,444,909 B2 * 11/2008 Repac et al. ..... 83/167

(Continued)

FOREIGN PATENT DOCUMENTS

CN 86 2 08393 U 2/1988

(Continued)

OTHER PUBLICATIONS

Notification of Transmittal dated Oct. 28, 2008 and Translation of Written Opinion of The International Searching Authority for PCT Application No. PCT/EP2007/002085.

*Primary Examiner*—Hwei-Siu C Payer
(74) *Attorney, Agent, or Firm*—Charles P. Boukus, Jr.

(57) ABSTRACT

The invention relates to a device for cutting produce, in particular vegetables or fruit, comprising a cutting part (5), arranged in the region of a receptacle (18) for the material to be cut, and a punch element (6) engaging in the receptacle (18), wherein the punch element (6) has recesses (10) for completely receiving the cutting blades (9) of the cutting part (5) when the device is in the closed position. According to the invention, fastening means are provided in the region of the receptacle (18) for the material to be cut for optionally fixing at least one additional cutting part (12), wherein the punch element (6) has recesses (13) for completely receiving the cutting blades (14) of the at least one additional cutting part (12).

22 Claims, 4 Drawing Sheets

U.S. PATENT DOCUMENTS

Figure 1:
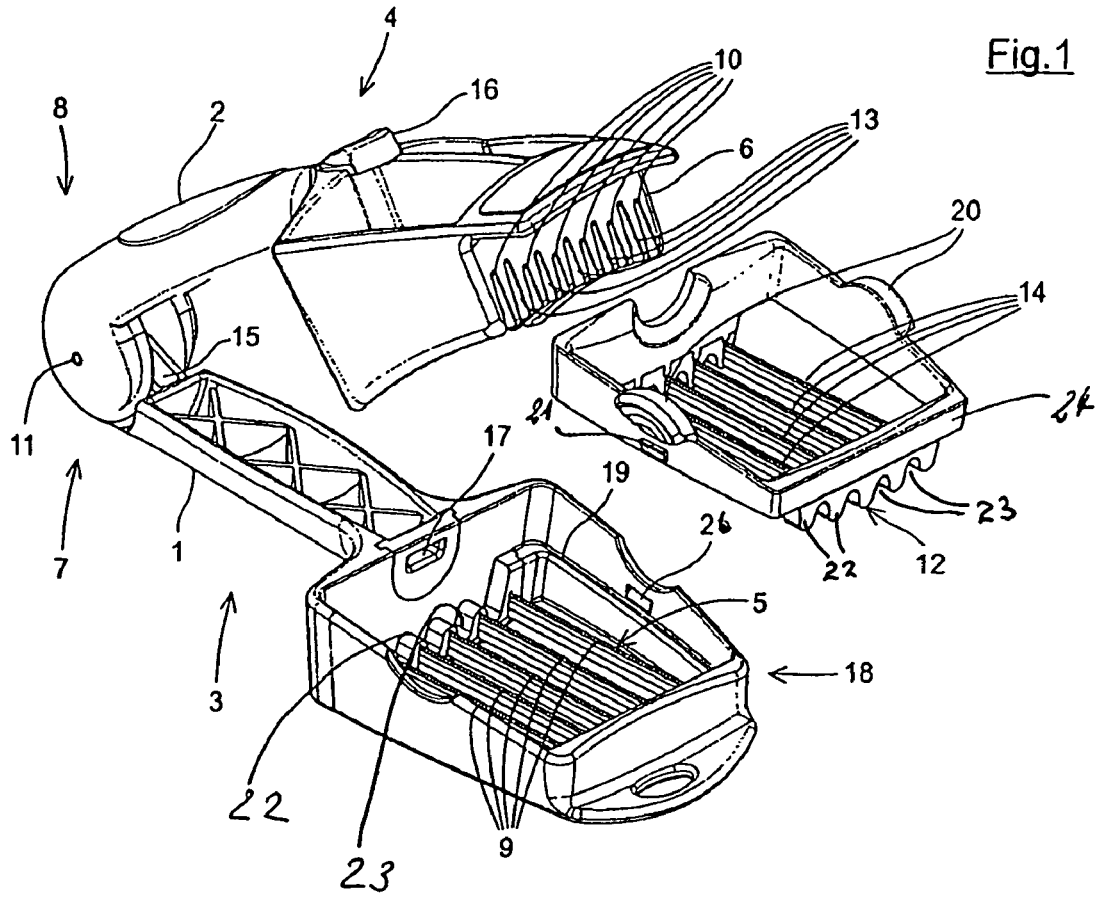

D591,115 S * 4/2009 Repac ..... D7/693

FOREIGN PATENT DOCUMENTS

| | | | |
|---|---|---|---|
| CN | 1496796 | A | 5/2004 |
| DE | 662188 | | 7/1938 |
| DE | 40109620.3 | | 2/2002 |
| DE | 102 42 651 | A1 | 4/2004 |
| DE | 20 2004 002 477 | | 6/2004 |
| EP | 114074 | A1 | 7/1984 |
| GB | 345750 | | 4/1931 |

* cited by examiner 6
20
22
23
25
21
26
9
A

DEVICE FOR CUTTING PRODUCE, IN PARTICULAR VEGETABLES OR FRUIT

The invention relates to a device for cutting produce, such as tropical fruit, orchard fruit, vegetables, eggs, meat, or similar material to be cut, in particular vegetables or fruit, having a cutting part disposed in the region of a receptacle for the material to be cut and having a punch element that engages the receptacle; the punch element has recesses for receiving the cutting blades of the cutting part when the device is in the closed position.

BACKGROUND OF THE INVENTION

One such device is known for instance from German Patent Disclosure DE 102 42 651 A1. The cutting device in this reference has a cutting part with a plurality of cutting blades. The cutting part is disposed on the free end of one handle part that is disposed pivotably relative to a further handle part. The further handle part, on its free end, has a punch element that is provided with receptacles, so that the cutting blades of the cutting part are located fully inside the receptacles.

From U.S. Pat. No. 4,062,260, a vegetable cutter is known, having a first and second knife holder; the second knife holder is disposed in an insertion groove above the first knife holder. The fixation of both knife holders is effected by pivoting a locking bar. A receptacle for the vegetables to be cut is located above the knife holder, and a punch element plunges into this receptacle. On the punch element, there are recesses which are engaged by the knives when the punch element is pressed downward. Because of the disposition of two knife holders, it is possible to create different cutting patterns with knives that either intersect at a right angle or extend parallel to one another.

PROBLEM

With these known devices, it is possible to cut vegetables into a shape that is defined by the cutting blades of the cutting part. However, if the material to be cut is to be put into a different shape, then separate devices, whose cutting parts have cutting blades with a different pattern or a different blade spacing, are necessary for the purpose.

The object of the invention is therefore to provide a device for cutting vegetables having a cutting part disposed in the region of a receptacle for the material to be cut and having a punch element engaging the receptacle, the cutting part with the receptacle and the punch element being disposed on the free ends of handle parts that are pivotably connected to one another, and the punch element having recesses for receiving cutting blades of the cutting part when the device is in a closed position, with which the material can be cut in a simple way into different sizes and shapes or patterns.

INVENTION AND ADVANTAGEOUS EFFECTS

This object is attained by a device of the type described above in which in the region of the receptacle for the material to be cut, securing means for selectively fixing at least one additional cutting part are provided, and the punch element has recesses for receiving the cutting blades of the additional cutting part. In a preferred embodiment, the securing means for the additional cutting part are embodied as detent means or clip or clamp means, which cooperate with counterpart detent, clip and/or clamp means on the receptacle. Preferably, handholds are provided on the additional cutting part, and the detent means, clip or clamp means can be brought into and out of engagement with the counterpart detent means, clip and/or clamp means that are formed in the region of the receptacle. In a preferred embodiment, the additional cutting part has retention means, which upon insertion into the receptacle, form essentially positive-engagement connection with counterpart retention means formed in the region of the receptacle.

By means of the at least one additional cutting part, it is possible with one and the same device to cut the vegetable that is to be cut into different sizes or different shapes and patterns. Because the punch element has recesses for completely receiving the cutting blades of the cutting part and the cutting blades of the at least one additional cutting part, it is assured that the material to be cut will be pressed all the way through the cutting blades and thus pressed all the way out of the device. After the cutting operation, the cut material can be collected in a simple way, for instance in a container, bowl, or boardlike tray.

In a first particular embodiment of the invention, it is provided that the securing means for additional cutting part are embodied as detent means or clip or clamp means, and counterpart detent, clip and/or clamp means cooperating with them. As a result, the additional cutting part can easily be secured in the region of the receptacle of the cutting device and can be removed from the cutting device for removal of the additional cutting part. For actuating the detent, clip a and/or clamp means, handholds, for instance, such as extensions of the wall and/or of the receptacle, may be provided on the additional cutting part that upon actuation put the detent elements out of engagement with counterpart detent elements on the receptacle and thus make it possible to release and remove the additional cutting part from the receptacle. Inserting the additional cutting element is done in reverse order of motion. It is especially advantageous that the additional cutting part, on insertion and removal, can be grasped by the handholds, for instance between the thumb and index finger of the user.

To avoid an unwanted shifting of the additional cutting part inside the receptacle, it is provided according to the invention that the additional cutting part has retention means, which upon insertion into the receptacle, form an essentially positive-engagement connection with counterpart retention means that are formed in the region of the receptacle. As a result, even relatively hard kinds of produce, such as carrots, onions, and the like, can be cut without shifting or other movement of the additional cutting part in the receptacle.

This positive-engagement connection can be attained in a structurally especially simple way by providing that between the additional cutting part and the receptacle, corresponding protrusions and indentations are formed, such as ribs with indentations formed between the ribs, or similar shaped features adapted to one another, between the components that are to be joined.

Manipulating the additional cutting part, or in other words inserting it into the receptacle and removing it, proves especially simple if the cutting blades of the additional cutting part are retained on a frame part that is insertable into the receptacle. In this respect it is recommended that the securing means for the additional cutting part, such as the clamp, detent and/or clip means, be disposed on the frame part. The handhold for actuating the securing means may also be embodied on the frame part, for instance with wall extensions that extend past the edge of the receptacle in the inserted position of the additional cutting part. As a result, the frame part can be pressed together at opposed wall portions, so that the detent elements or lugs and the like, formed on these wall portions of the frame part, become disengaged from the counterpart detent means of the receptacle. Especially easy insertion of the additional cutting part into the receptacle, and its removal from the receptacle, are thus made possible. The user merely has to grasp the extensions of the wall opposite the frame part, which for instance protrude upward, and press them together.

It is also within the scope of the invention to insert a positive-engagement means, instead of the additional cutting part, into the blind frame, so that unwanted crushing or compression of the material to be cut by protruding elements in the region of the receptacle is avoided.

In accordance with a special concept of the invention, it is provided that the cutting blades of the cutting part and of the additional cutting part have serration, which in particular facilitates cutting relatively soft types of vegetables. Embodying the cutting blades with teeth is especially suitable in a version of the device in the form of a tong-like cutting device, preferably for one-handed operation.

In an advantageous feature of the invention, it is provided that the cutting blades of the additional cutting part extend parallel to the cutting blades of the cutting part once the additional cutting part has been inserted. These may be parallel blades that extend longitudinally, or concentric circles or blades in curved form may be used.

As a result of this provision, different cutting thicknesses and shapes of the cut material can be attained.

In the case of blades of the cutting part and of the additional cutting part that extend longitudinally and substantially parallel to one another, it is recommended that the cutting blades of the cutting part and of the additional cutting part overlap, at least in some regions, as viewed in the transverse direction. For instance, the cutting blades of the additional cutting part may extend into the interstice between adjacent cutting blades of the cutting part. As a result, a cleaner cut is attained, especially with relatively soft types of vegetables, such as tomatoes, without crushing the material to be cut. The cutting blades that enter into interaction with the material to be cut first in the cutting direction, such as the cutting blades of the additional cutting part, in a practical way form a guide for the pieces of vegetables that at this point have already been cut, once these pieces, in the further cutting motion, enter into interaction with the other cutting blades, in particular those of the cutting part.

The embodiment of the invention in which the cutting blades of the additional cutting part extend at a right angle to the cutting blades of the cutting part has the same objective.

Naturally, it may also be provided that the cutting blades of the additional cutting part be made to extend at an angle of between 0 and 90 degrees to the cutting blades of the cutting part. By this means as well, different cutting shapes and sizes can be attained in a simple way, by using the cutting device with and without the additional cutting part.

In a further concept of the invention, the cutting part with the receptacle, on the one hand, and the punch element, on the other, are disposed on retaining elements that are pivotably joined to one another. Because of this pivotability, the material to be cut can easily be cut, since as a result leverage can be employed that minimizes the expenditure of force in cutting.

Advantageously, the cutting part and the punch element are disposed on the free ends of handle parts that are pivotably joined in their opposed end regions. By this provision, simple one-handed operation of the cutting device is assured, since both handle parts can be operated with one hand in cutting the material to be cut. This embodiment is especially suitable for cutting relatively soft vegetables, such as mushrooms.

It has proved advantageous that the two handle parts come to rest on one another when the device in the closed position. As a result of this provision, only very little space is required when the device is not needed and can be put away.

So that the device will stay in the open position before vegetables are cut, the device is kept in the open position by means of a spring disposed between the handle parts. As a result, the device can be equipped with the vegetables to be cut without the two handle parts, and thus the cutting part and the punch element, moving into their closed position by the force of gravity.

In a further concept of the invention, detent and clip or similar corresponding elements are disposed on the handle parts, or on the punch element and the cutting part, in order to keep the device in the closed position, for instance when it is to be put away when not used. This is particularly advantageous whenever a spring whose restoring force keeps the two handle parts in the open position is disposed between the handle elements.

It has also proved advantageous that the receptacle provided on the free end of one handle part is formed by an encompassing wall. The cutting part with its cutting blades is then disposed, preferably detachably, on the lower end, in the position for use, of the sleevelike receptacle. This assures that the vegetable to be cut is securely held.

It is especially favorable if the punch element fills up its receptacle completely and in positive-engagement fashion in the closed position, and thus presses the vegetable to be cut all the way through the cutting grid. This makes for efficient functioning of the cutting device.

The invention furthermore relates to an additional cutting part with cutting blades for disposition in a device according to the invention for cutting vegetables.

EXEMPLARY EMBODIMENT

Further possible applications, advantages, characteristics, and features of the invention will become apparent from the ensuing description of an exemplary embodiment in conjunction with the drawings. All the characteristics described and/or shown form the subject of the present invention in arbitrary useful combination, even independently of how they are worded in the claims and independently of the claims dependencies.

Figure 2:
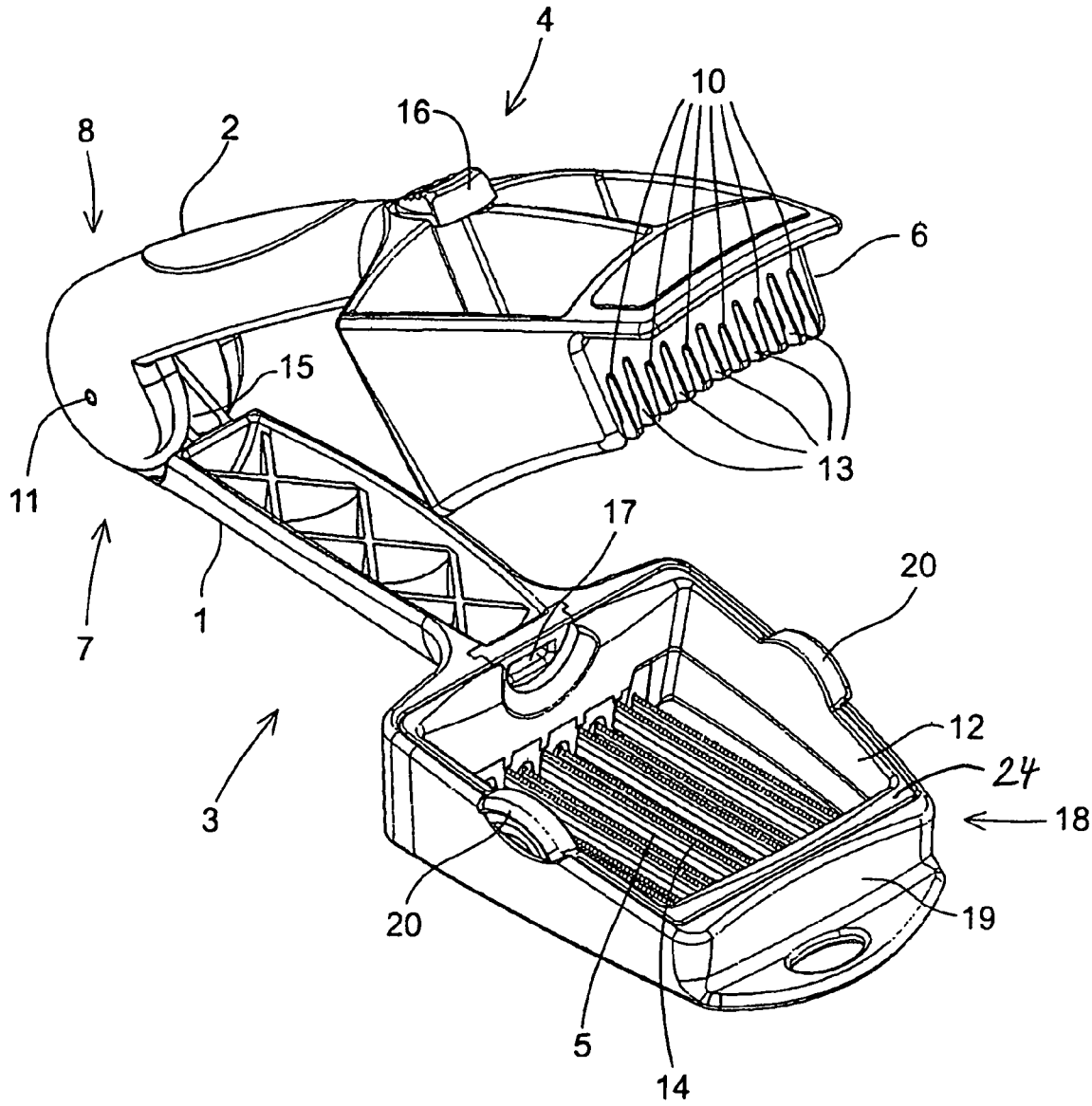
Figure 3:
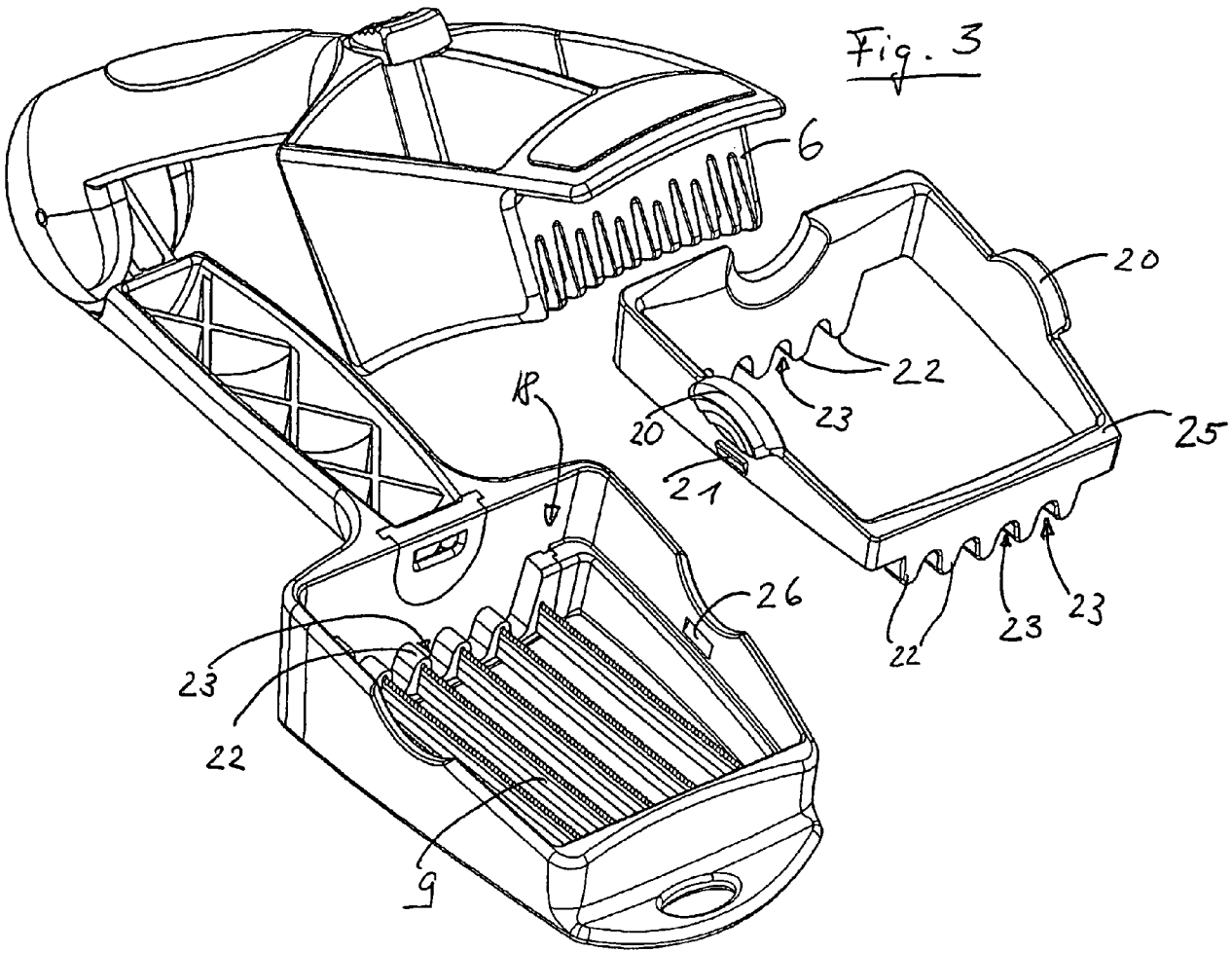
Figure 4:
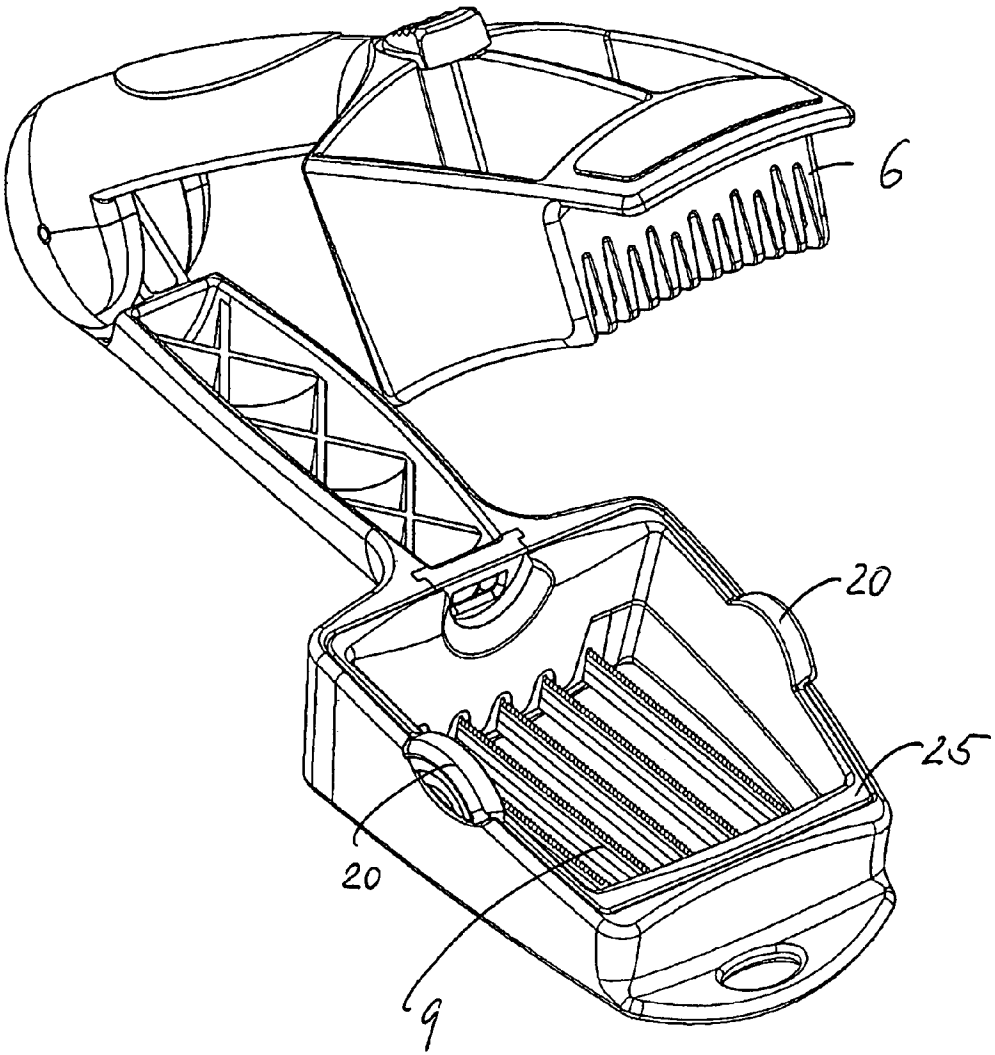

Shown are:

FIG. 1, one exemplary embodiment of a device according to the invention for cutting vegetable, in the open state, with an additional cutting part before it is inserted;

FIG. 2, the device of FIG. 1 with the additional cutting part disposed in it;

FIG. 3, the device of FIG. 1 before the insertion of a blind frame, instead of an additional cutting part; and FIG. 4, the device of FIG. 3, with the blind frame inserted.

With the cutting device shown in the drawings, relatively soft vegetables, in particular, can be cut without major expenditure of force.

The device essentially comprises two handle elements 1, 2 which are joined pivotally to one another at their end regions 7, 8 via a pivot bearing 11, and which on their free ends 3, 4 have a receptacle 18 for the vegetables to be cut, with a cutting part 5 disposed in the receptacle, and a punch element 6 corresponding to the cutting part. The cutting part 5 has cutting blades 9, which in the closed position of the device fully engage recesses 10 in the punch element 6.

As shown in FIGS. 1 and 2, an additional cutting part 12 with cutting blades 14 is provided, which is likewise retained in the receptacle 18, but in the exemplary embodiment selected here in the cutting part 5. In the exemplary embodiment selected here, the cutting blades 14 of the additional cutting part 12 are each located between two cutting blades 9 of the cutting part 5, and the individual cutting blades 14, viewed in the transverse direction, overlap. On the punch element 6, further recesses 13 are provided, which are engaged by the cutting blades 14 of the additional cutting part 12. In the closed state of the device, the cutting blades 14 of the additional cutting part 20 are then completely received by the recesses 13.

The receptacle 18 for the material to be cut is formed by an encompassing wall 19 on the free end of one handle part 1. The cutting part 5 is disposed, optionally detachably, inside this receptacle 18. The receptacle 18, or the wall 19 that forms it, has recesses 26, on which the additional cutting part 12 can be detachably disposed with detent elements 21.

For filling the device with material to be cut, a spring 15 is disposed between the handle parts 1 and 2; it keeps the two handle parts 1, 2 in the open position shown in the drawings.

Counter to the force of the spring 15, the handle parts 1 and 2 can be pivoted toward one another. In the process, the punch element 6 is received essentially by positive engagement by the receptacle 18, so that vegetables disposed in the receptacle 18 are pressed all the way through the blades 9 of the cutting part 5. The cutting blades 9 of the cutting part 5 are received completely in the recesses 10 of the punch element 6.

The material to be cut is now cut to a certain size. In the case of the cutting part 5 shown in the drawings, its blades 9 are parallel to one another in the longitudinal direction. The cut material after a cutting operation has therefore been cut into slices of a certain size.

If it is intended that material to be cut be cut into narrower slices, then the additional cutting part 12 is inserted into the receptacle 18; the cutting blades 14 of the additional cutting part 12 extend parallel to the cutting blades 9 of the cutting part 5. Compared to the cutting operation without the additional cutting part 12, the size of the slice for the material to be cut is reduced.

The additional cutting part 12 has a frame part 24, for instance of plastic, and the cutting blades 14 are cast integrally in it. It is understood that it is also possible for the additional cutting part 12 and its frame part 24 to be made from some different material and for the cutting blades 14 to be secured in it in some other way.

For the insertion, the additional cutting part 12 is grasped, for instance by the thumb and index finger of the user, at the handholds 20 that protrude from the frame part 24, and its corresponding wall portions are pressed inward somewhat. Next, the additional cutting part 12 is inserted into the receptacle 18; the protrusions and the ribs 22 and indentations 23, formed in the receptacle 18 or on the cutting part 5, enter into engagement with the corresponding ribs 22 and indentations 23 between them in the frame part 24. Simultaneously, the detent elements 21 on the frame part 24 reach the regions of the associated counterpart detent means 26, embodied as recesses in the wall portions of the wall 19. When the handholds 20 are let go, the wall portions of the frame part 24 spring back, causing the detent elements or lugs 21 to engage the recesses 26 of the receptacle 18. As a result, a secure hold of the additional cutting part 12 in the receptacle 18 is attained.

In the event that an additional cutting part 12 is not to be used, it may be recommended that a blind frame 25, of the kind shown in FIGS. 3 and 4, be inserted into the receptacle 18. The blind frame 25 is embodied in a manner corresponding to the frame part 24 of the additional cutting part 12, thus preventing of the fruits to be cut by the ribs 22 and indentations 23 in the receptacle 18 from being crushed. The blind frame 25 also serves to cause the punch element 6 to be received in the receptacle by positive engagement when the additional cutting part 12 is not present, so that in that usage as well, the fruit or vegetables to be cut are pressed all the way through the cutting blades 9 of the cutting part 5.

To make it possible for the entire device to be put away simply and in a space-saving way and not kept in the open position by the force of the springs 15, detent and clip elements 16 and 17 are provided on the handle parts 1 and 2. In the closed position, the handle parts 1 and 2 rest directly on one another, and the punch element 6 is received entirely within the receptacle 18. In this respect, it does not matter whether the additional cutting part 12 is disposed in the receptacle 18, or not. The device is kept in this closed position, counter to the force of the spring 15, by the detent and clip elements 16, 17 disposed on the handle parts 1 and 2.

If a cutting operation is to be started instead, these detent and clip elements 16 and 17 are disengaged; this causes the spring 15 to move the two handle parts 1 and 2 into the open position shown in the drawings. Vegetables or the like can now be placed in the receptacle 18 again, and a further cutting operation can be started.

List of Reference Numerals

| | |
|---|---|
| 1 | Handle part |
| 2 | Handle part |
| 3 | Free end |
| 4 | Free end |
| 5 | Cutting part |
| 6 | Punch element |
| 7 | End region |
| 8 | End region |
| 9 | Cutting blades |
| 10 | Recesses |
| 11 | Pivot point |
| 12 | Additional cutting part |
| 13 | Recesses |
| 14 | Cutting blades |
| 15 | Spring |
| 16 | Clip element |
| 17 | Detent element |
| 18 | Receptacle |
| 19 | Wall |
| 20 | Handhold |
| 21 | Detent element |
| 22 | Positive-engagement means, rib |
| 23 | Counterpart positive-engagement means, indentation |
| 24 | Frame part |
| 25 | Blind frame |
| 26 | Counterpart detent element, recess |

The invention claimed is:

1. A device for cutting produce having a cutting part (5) disposed in the region of a receptacle (18) for material to be cut and having a punch element (6) engaging the receptacle (18), the cutting part (5) with the receptacle (18) and the punch element (6) being disposed on the free ends (3, 4) of handle parts (1, 2) that are pivotably connected to one another on their opposed end regions (7, 8), and the punch element (6) having recesses (10) for receiving cutting blades (9) of the cutting part (5) when the device is in a closed position, characterized in that in the region of the receptacle (18) for the material to be cut, securing means for selectively fixing at least one additional cutting part (12) with cutting blades (14) are provided, the additional cutting part (12) has retention means (22, 23), which upon insertion into the receptacle (18) form a positive engagement connection with counterpart retention means (22, 23) on the receptacle (18) to prevent shifting of the additional cutting part (12) within the receptacle (18), and the punch element (6) has recesses (13) for receiving the cutting blades (14) of the at least one additional cutting part (12).

2. The device as defined by claim 1, characterized in that the securing means for the additional cutting part (12) are embodied as detent means (21) formed on the additional cutting part (12) which cooperate with counterpart detent means (26) on the receptacle (18).

3. The device as defined by claim 2, characterized in that handholds (20) are provided on the additional cutting part (12), and the detent means (21) of the additional cutting part (12) can be brought into and out of engagement with the counterpart detent means (26) of the receptacle (18) by grasping the handholds (20).

4. The device as defined by claim 3, characterized in that the cutting blades (14) of the additional cutting part (12) are retained on a frame part (24) that is insertable into the receptacle (18).

5. The device as defined by claim 4, characterized in that the handholds (20), the detent means (21), and the retention means (22, 23) are formed on the frame part (24).

6. The device as defined by claim 4, characterized in that the handholds (20) are formed as extensions of opposed wall portions of the frame part (24) such that the handholds (20) can be grasped by a user for insertion and removal of the additional cutting part (12).

7. The device as defined by claim 6, characterized in that the extensions of the wall portions extend past the edge of the receptacle (18) in the inserted position of the additional cutting part (12).

8. The device as defined by claim 7, characterized in that the detent means (21) are formed as detent elements on the opposed wall portions of the frame part (24) and the counterpart detent means (26) are formed as recesses in the receptacle (18).

9. The device as defined by claim 8, characterized in that the frame part (24) can be pressed together at the opposed wall portions by grasping the handholds (20) such that the detent elements can be engaged in and disengaged from the recesses.

10. The device as defined by claim 1, characterized in that the positive engagement connection between the additional cutting part (12) and the receptacle (18) is provided by the retention means of the additional cutting part which comprises a plurality of alternating protrusions (22) and indentations (23) formed on the cutting part (12) which engage a plurality of corresponding protrusions (22) and corresponding indentations (23) of the counterpart retention means formed on the receptacle (18).

11. The device as defined by claim 1, characterized in that instead of the additional cutting part (12), a blind frame (25) is insertable into the receptacle (18).

12. The device as defined by claim 1, characterized in that the cutting blades (9, 14) of the cutting part (5) and the additional cutting part (12) have serration.

13. The device as defined by claim 1, characterized in that in the inserted position of the additional cutting part (12), its cutting blades (14) extend substantially parallel to the cutting blades (9) of the cutting part (5).

14. The device as defined by claim 13, characterized in that the cutting blades (9, 14) of the cutting part (5) and the additional cutting part (12), viewed in the transverse direction, overlap.

15. The device as defined by claim 1, characterized in that in the inserted position of the additional cutting part (12), its cutting blades extend at a right angle to the cutting blades (9) of the cutting part (5).

16. The device as defined by claim 1, characterized in that in the inserted position of the additional cutting part (12), its cutting blades (14) extend at an angle of between 0° and 90° to the cutting blades (9) of the cutting part (5).

17. The device as defined by claim 1, characterized in that the cutting part (5) having the receptacle (18), on the one hand, and the punch element (6), on the other, are disposed on retaining elements that are pivotably joined together.

18. The device as defined by claim 1, characterized in that the two handle parts (1, 2) come to rest on one another when the device is in the closed position.

19. The device as defined by claim 1, characterized in that the handle parts (1, 2) are held in an open position by a spring (15) disposed between the handle parts (1, 2).

20. The device as defined by claim 19, characterized in that detent and clip elements (16, 17) are disposed on the handle parts (1, 2) or on the punch element (6) and the cutting part (5), in order to keep the device in the closed position.

21. The device as defined by claim 1, characterized in that the receptacle (18), provided on the free end (3) of one handle part (1), for the additional cutting part (12) is embodied as an encompassing wall (19).

22. The device as defined by claim 1, characterized in that the cutting part (5) with its cutting blades (9) is disposed, detachably, on the lower end of the receptacle (18).

* * * * *